US008686912B2

(12) United States Patent
Bin Jamlus et al.

(10) Patent No.: US 8,686,912 B2
(45) **Date of Patent: *Apr. 1, 2014**

(54) 450 MHZ FOLDED DIPOLE ANTENNA

(75) Inventors: Norman Bin Jamlus, Kuala Lumpur (MY); Azhari Bin Asrokin, Negeri Sembilan Darul Khusus (MY); Rizal Helmy Bin Basri, Selangor Darul Ehsan (MY); Anas Bin Abas, Selangor Darul Ehsan (MY)

(73) Assignee: Telekom Malaysia Berhad, Kuala Lumpur (MY)

( * ) Notice: Subject to any disclaimer, the term of this patent is extended or adjusted under 35 U.S.C. 154(b) by 197 days.

This patent is subject to a terminal disclaimer.

(21) Appl. No.: 13/339,959

(22) Filed: Dec. 29, 2011

(65) Prior Publication Data

US 2012/0188140 A1 Jul. 26, 2012

(30) Foreign Application Priority Data

Dec. 30, 2010 (MY) ..... PI 2010006327

(51) Int. Cl.
*H01Q 1/28* (2006.01)

(52) U.S. Cl.
USPC ..... 343/795; 343/797; 343/803; 343/814

(58) Field of Classification Search
USPC ..... 343/793, 795, 803, 812, 813, 814, 797
See application file for complete search history.

(56) References Cited

U.S. PATENT DOCUMENTS

| | | | | |
|---|---|---|---|---|
| 3,742,512 | A * | 6/1973 | Munson | 343/814 |
| 3,887,925 | A * | 6/1975 | Ranghelli et al. | 343/795 |
| 5,087,922 | A * | 2/1992 | Tang et al. | 343/814 |
| 6,067,053 | A * | 5/2000 | Runyon et al. | 343/797 |
| 6,211,840 | B1 * | 4/2001 | Wood et al. | 343/793 |
| 6,844,851 | B2 * | 1/2005 | Yoon et al. | 343/700 MS |
| 6,853,346 | B2 * | 2/2005 | Annabi et al. | 343/803 |

* cited by examiner

*Primary Examiner* — Tho G Phan
(74) *Attorney, Agent, or Firm* — Nath, Goldberg & Meyer; Jerald L. Meyer

(57) ABSTRACT

A folded dipole antenna capable of transmitting and receiving signals from CDMA 450 system comprises a folded dipole Printed Circuit Board (PCB) having conducting strips on each side of the PCB forming excitation and grounding arms of the antenna, having a symmetric conducting strip configuration. The conducting strip on each side of the PCB includes an m-shaped conducting strip having a center conducting leg, and two symmetrically configured folded arms. The center conducting leg is thinner in width than the two folded arms. The PCB is placed is mounted perpendicularly to a base plate through a plastic holder. A coaxial cable having a center core extended through the folded dipole PCB connects with the excitation arm and with a metal shield soldered along the center conducting leg of the ground arm.

14 Claims, 6 Drawing Sheets

450 MHZ FOLDED DIPOLE ANTENNA

FIELD OF THE INVENTION

The present invention relates to a folded dipole antenna. In particular, the present invention relates to a folded dipole antenna that is of a directional type, adapted for receiving a frequency in a range of 450-470 MHz.

BACKGROUND

The mobile telecommunications industry is one of the most rapidly growing sectors in the telecommunications industry. Mobile telecommunications allows people to communicate over a wide area on the move, by using a grouping of radio, telecommunication device and computer technology.

Mobile telecommunications includes a family of standards better known as the Third Generation (3G). 3G systems allow a faster communication service that includes simultaneous data services and voice communications. It allows users to access the Internet on the move as it can be used anywhere. A significant 3G standard is the Code Division Multiple Access 2000 (CDMA 2000).

CDMA 2000 is part of the 3G mobile telecommunications standard which uses CDMA as a channel access method. A proven efficiency and performance of CDMA 2000 with the coverage of the 450 MHz frequency band is the CDMA 450. CDMA 450 is one of the rapidly emerging categories in the communication technology. This allows users to receive telecommunication coverage in areas where lower frequencies and longer distance coverage are required. An example would be users who are frequent travelers to rural areas and residents of rural areas.

With various frequency ranges available in the mobile telecommunication industry, traditional design approaches may involve multiple antennas. A dipole antenna is typically used as a radio antenna that can be fed with a balanced, parallel-wire radio-frequency (RF) transmission line. However, as this type of line is uncommon, an unbalanced feed line, such as a coaxial cable, can be used. This feed line is inserted in the antenna element system at the point where the feed line joins the antenna. The dipole antenna is best suited to operate in a single frequency band for devices operating according to the CDMA.

Traditional antenna designs for a lower frequency range, such as from 450-470 MHz, are generally big and bulky. Such antennas are not suited for applications where smaller-sized antennas are required.

Signal controls in each of the antenna elements also has to be taken into accountability, which complicates the communication process and causes an increase in the power consumption. Typically, a higher decibel (dB) gain is preferred for better signal strength. However, antennas with higher gain are more expensive to manufacture due to the complexity of the feed network of the antenna.

SUMMARY

It can thus be seen that there exists a need for a relatively small and compact in size antenna that is able to support an operating frequency of 450-470 MHz. This design exhibits sufficient impedance bandwidth and is simple to assemble with a short manufacturing time. It would also be advantageous if an antenna is more cost-effective and yet, is still able to provide superior performance, which can overcome the disadvantages of the existing prior art.

A folded dipole antenna capable of supporting a CDMA 450 system that is compact and small in size is disclosed. According to one embodiment of the present invention, the antenna includes a folded dipole PCB, a coaxial cable and SMA connector, a plastic holder made from Acrylonitrile Butadiene Styrene (ABS) and a base plate made from Aluminum.

In one aspect of the present invention, there is provided a folded dipole antenna capable of transmitting and receiving signals from CDMA 450 system. The folded dipole antenna comprises a folded dipole Printed Circuit Board (PCB) having conducting strips defined on each side of the folder dipole PCB forming an excitation arm and a grounding arm of the antenna, both excitation arm and the grounding arm are adapted with symmetric a conducting strip configuration, wherein the conducting strip on each side of the PCB comprises an m-shaped conducting strip having a center conducting leg, and two symmetrically configured folded arms, wherein the center conducting leg is thinner in width than the two folded arms; a plastic holder whereby the folded dipole PCB is placed through; a base plate whereby the folded dipole PCB is mounted perpendicularly onto the base plate through the plastic holder; and a coaxial cable having a center core extended through the folded dipole PCB to connect with the excitation arm at one end, and a metal shield soldered along the center conducting leg of the ground arm, wherein the other end of the coaxial cable is extending through the base plate with a connector.

In one embodiment, the plastic holder is made from Polytetrafluoroethylene and is an I-beam shaped plastic piece. The plastic holder may further comprise an upper flange and a lower flange connected by a web, the plastic holder further define a slot that cuts from the upper flange into the web for receiving the folded dipole PCB there between. One side of the plastic holder may have cut-off area that allows the coaxial cable to run through. The plastic holder is adapted to support the folded dipole PCB upright on the base plate.

In another embodiment, the base plate is adapted as a reflector to the folded dipole antenna, to create a directional antenna.

In a further embodiment, the two symmetrically configured folded arms may have a total average length, L, of approximately 240 mm, a width, W, of approximately 24 mm, and the center conducting strip may have a length of approximately 62 mm and a width of 5 mm.

In yet a further embodiment, the folded dipole PCB has a height of approximately 200 mm.

In yet another embodiment, the folded dipole antenna has a front-to-back ratio greater than 15 dB. The folded dipole antenna is also capable to have a maximum input power of 500 W and a horizontal beam width of 90°±5° and a gain of 6±0.5 dB.

Further, the base plate may have a length and width of 400 mm.

In a further embodiment, the m-shaped conducting strip defining a gap separating the symmetrically configured folded arms of the m-shaped conducting strip into a first conducting strip and a second conducting strip, the first conducting strip includes one of the symmetrically configured folded arm and the center conducting leg forming an inverted U-shaped conducting strip whilst the second conducting strip include the other symmetrically configured folded arm forming an inverted L-shaped conducting strip.

BRIEF DESCRIPTION OF THE DRAWINGS

This invention will be described by way of non-limiting embodiments of the present invention, with reference to the accompanying drawings, in which.

DETAILED DESCRIPTION

Figure 1:
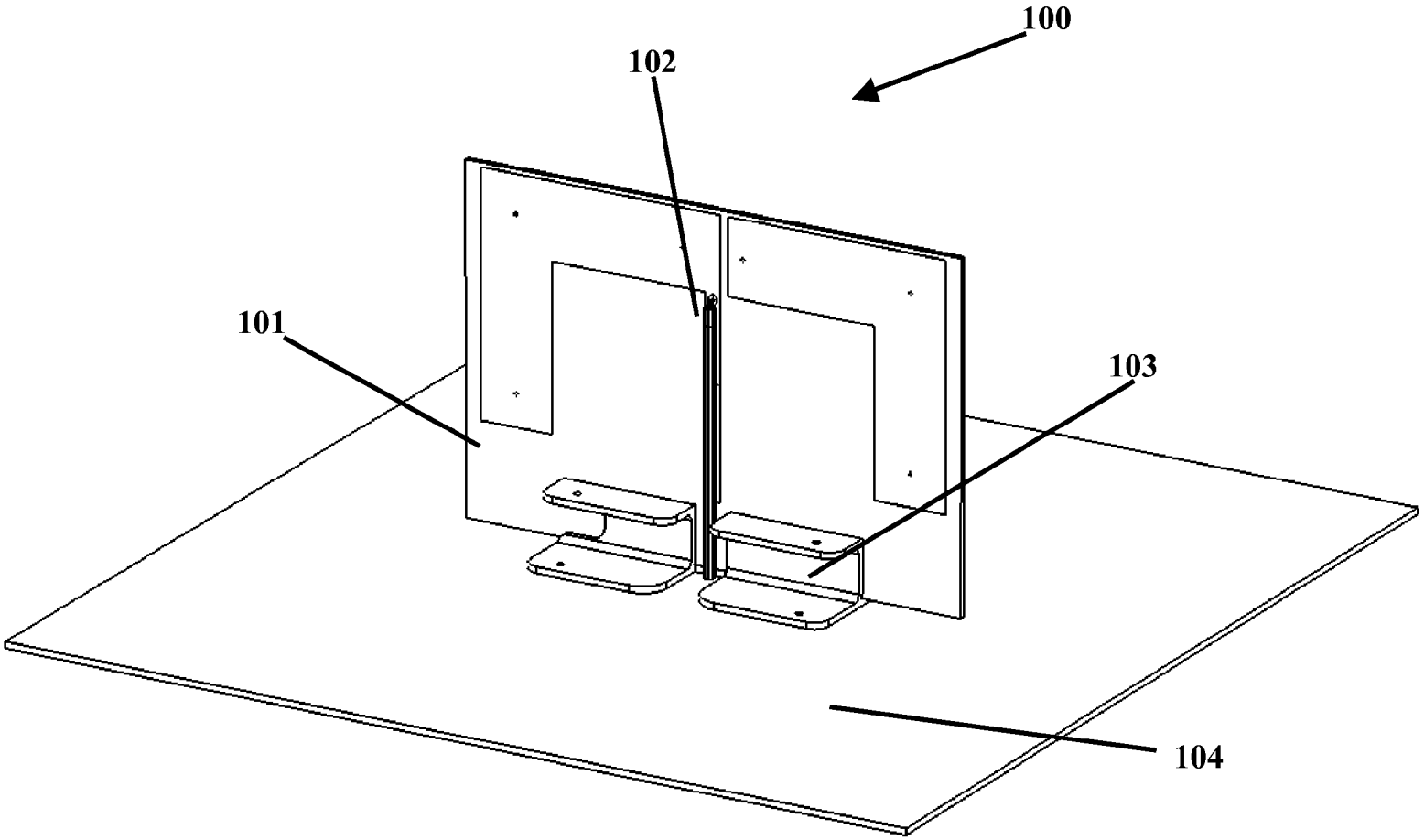
FIG. 1 illustrates a structure of a folded dipole antenna in accordance with an embodiment of the present invention.

The following descriptions of a number of specific and alternative embodiments are provided to understand the inventive features of the present invention. It shall be apparent to one skilled in the art, however that this invention may be practiced without such specific details. Some of the details may not be described in length so as to not obscure the invention. For ease of reference, common reference numerals will be used throughout the figures when referring to same or similar features common to the figures.

FIGS. 1-5 illustrate a folded dipole antenna (100) according to one embodiment of the present invention. FIG. 1, which shows a perspective view of the folded dipole antenna (100), provides a directional antenna that can be used for CDMA 2000 that operates at a frequency range of 450-470 MHz, i.e. CDMA 450. The folded dipole antenna (100) includes a folded dipole Printed Circuit Board (PCB) (101), a coaxial cable (102), a plastic holder (103) and a base plate (104). The folded dipole PCB (101) is mounted perpendicularly to the base plate (104) through the plastic holder (103) forming substantially an inverted-T cross-section. The coaxial cable (102) soldered to the folded dipole PCB (101) at one end, and extends towards the centre of the base plate (104).

Figure 2:
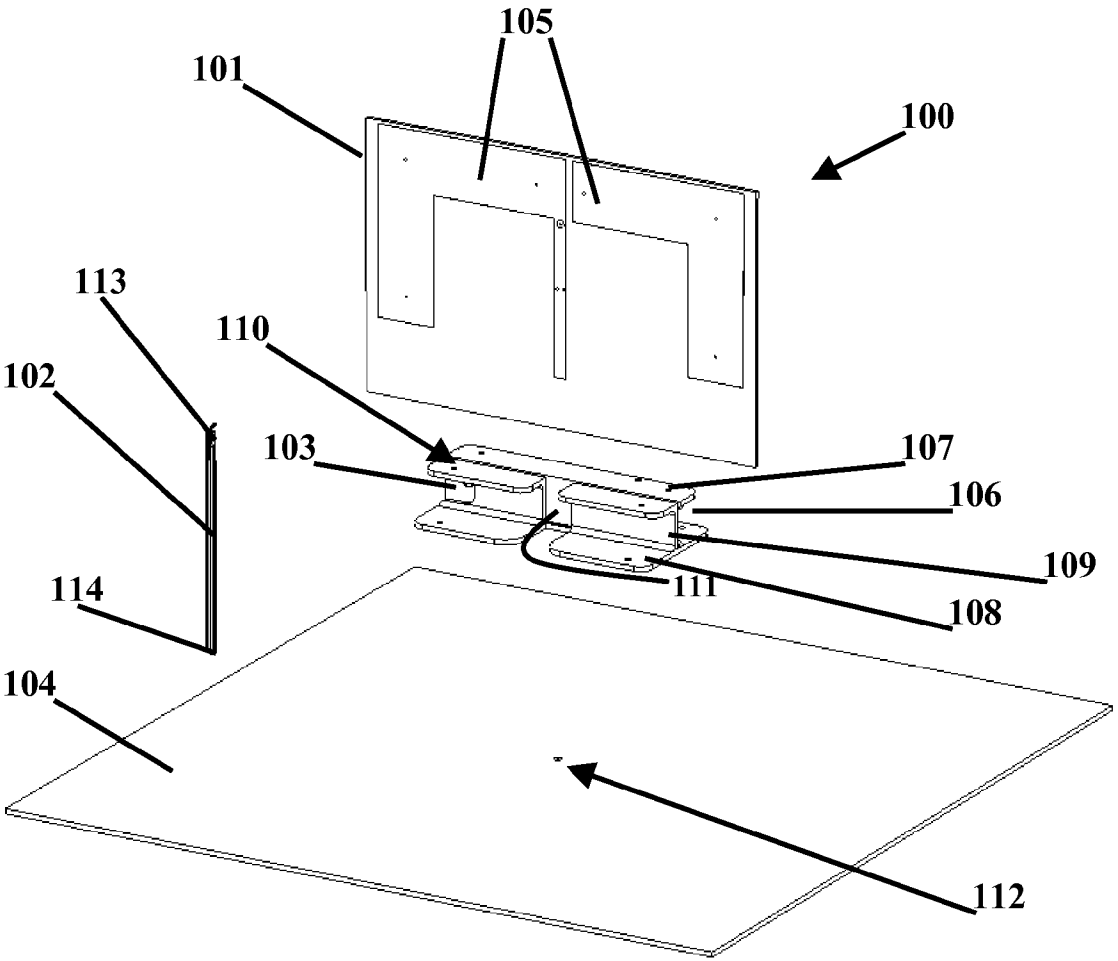
FIG. 2 illustrates an exploded view of the folded dipole antenna shown in FIG. 1.

FIG. 2 shows an exploded view of the folded dipole antenna (100) of FIG. 1. The folded dipole PCB (101) is substantially a rectangular shaped microstrip antenna with conducting strips (105) defined on both "dipole arms" of the folded dipole PCB (101). Details of the configurations of the microstrip will be provided later below. The plastic holder (103) includes an I-beam shaped plastic piece (106) having an upper flange (107) and a lower flange (108) connected to a web (109). A slot (110) that cuts from the upper flange (107) into the web (109) is defined for receiving the folded dipole PCB (101) there between. One side of the plastic holder (103) has a cut-off area (111) for allowing the coaxial cable (102) to run through when it is attached to one dipole arm of the folded dipole PCB (101). The plastic holder (103) can be made from Acrylonitrile Butadiene Styrene (ABS) for example, which can be used as a support for holding the folded dipole PCB (101) onto the base plate (104).

Still referring to FIG. 2, the base plate (104) can be made from Aluminum, as it is light in weight and easy to be formed. The base plate (104) acts as a reflector to the folded dipole PCB (101), which makes the folded dipole antenna (100) directional. Directional antenna provides relatively higher gain than a non-directional antenna of the same or similar configuration. The dimensions of the base plate (104) controls the beam width of the radiation pattern while causing minor effect to the Voltage Standing Wave Ratio (VSWR). The VSWR is a voltage ratio that measures how well a load is matched to the circuit driving it. The beam width of the folded dipole antenna (100) affects the antenna gain. Accordingly, the modification of the size of the base plate may offer different performance of the folder dipole antenna (100). Preferably, the size of the base plate (104) should be around a half-wavelength of the operation frequency of the antenna depending on the permittivity of the material the antenna being etched on. In the present embodiment, the folded dipole antenna (100) has a horizontal beam width of 90°±5° and a gain of 6±0.5 dB. The overall length and width of the base plate (104) is approximately 400 mm each. A through hole (112) is further provided at slightly off the center of the base plate (104).

Figure 3:
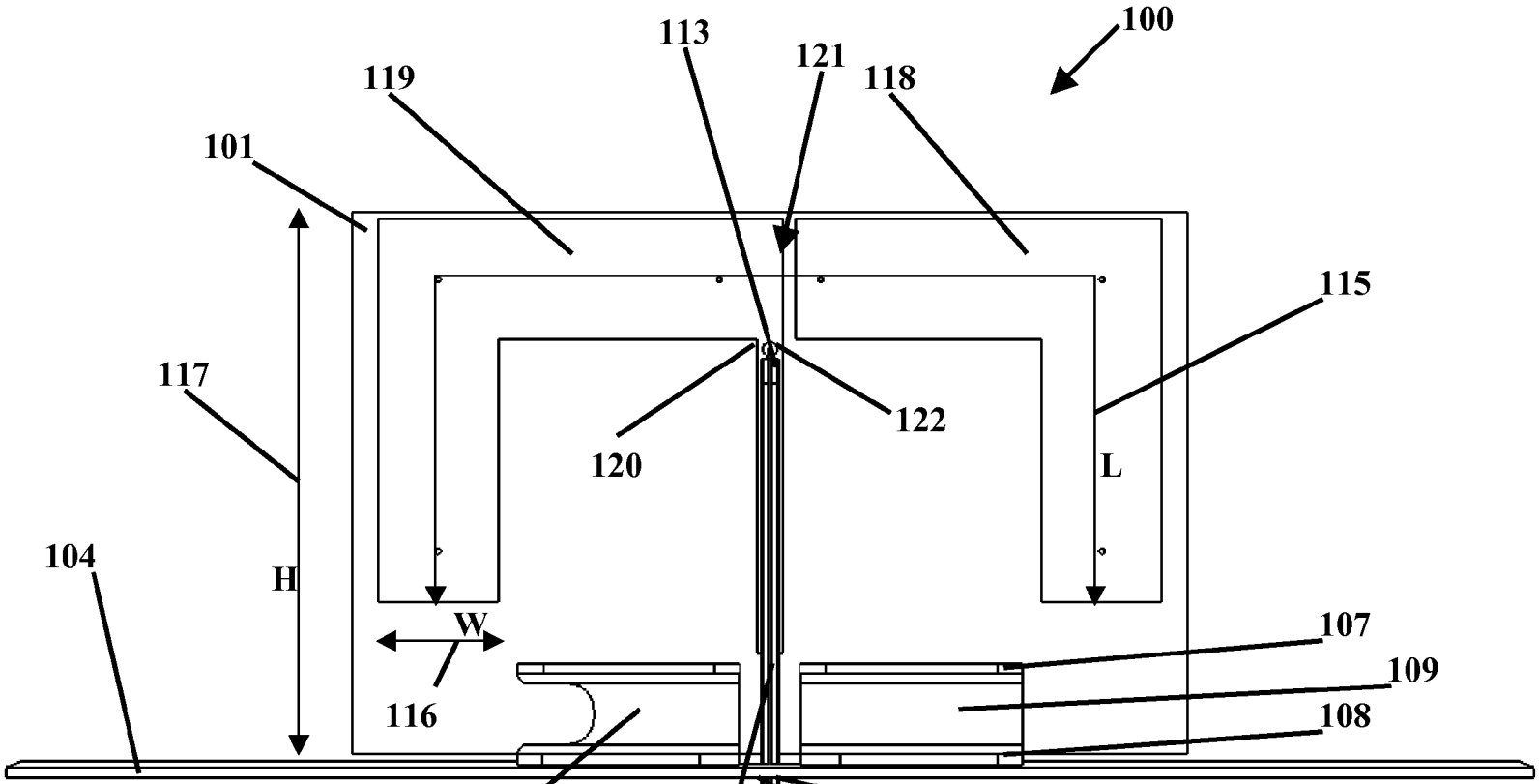
FIG. 3 illustrates a front view of the folded dipole antenna of FIG. 1.

FIG. 3 shows a front view of the folded dipole antenna (100) of FIG. 1 where the elements forming the conducting strips are illustrated with the respective dimensions. As shown, the folded dipole PCB (101) is mounted perpendicularly on the base plate (104). When mounted, the lower flange (108) of the plastic holder (103) is attached to the base plate (104). The folded dipole PCB (101) is sandwiched by the plastic holder (103) through the slot (110) (See FIG. 2). When necessary, the folded dipole PCB (101) may further be secured on the plastic holder (103) through a snap-in pin or the like of the plastic holder (103). The cut-off area (111) (See FIG. 2) allows the coaxial cable (102) to run through the plastic holder (103) to reach the base plate (104) when it is attached to the folded dipole PCB (101) to the base plate (104).

Still referring to FIG. 3, the folded dipole PCB (101) includes two symmetric "m"-shaped conducting strips formed on each side of a substrate of the folded dipole PCB (101) respectively constituting the antenna elements. One side of the "m"-shaped (lower case) conducting strip is acted as a ground arm, whilst another is the antenna element that transmits the radio signals, also known as excitation arm. Each "m"-shaped conducting strip has a center conducting leg, and two symmetrically configured folded arms, wherein the two symmetrically configured folded arms are thicker width strip defined alongside the substrate of the folded dipole PCB (101) and a the center conducting strip is a thinner width strip (120) extending downwardly from the center of the thicker width strip and runs towards the opposing side of the substrate. The thinner width strip (120) can be used to match the impedance of the folded dipole antenna (100) to the required signal source. In this embodiment, the length of the thinner width strip (120) is approximately 62 mm and its width is approximately 5 mm. The length of the thinner width strip (120) terminates before reaching the plastic holder (103). The "m"-shaped conducting strip further includes a first conducting strip (118) and a second conducting strip (119). The first conducting strip (118) and the second conducting strip (119) are separated by a gap (121), in a manner that the first conducting strip (118) defines an inverted "L" shaped strip and the second conducting strip (119) defines an inverted "U" shaped strip. For easy reference, the entire "m"-shaped conducting strip is measured with an average length, L (115), a width, W (116) and a height, H (117). For matching the impedance of the antenna in the present embodiment, the dimensions of the conducting strip can be approximately 240 mm for L (115), approximately 24 mm for the W (116) of the thicker conducting strips and approximately 200 mm for H (117).

As mentioned, the length, L (115), is dependant on half-wavelength, of the desired operating frequency of the folded dipole antenna (100). Preferably, the length, L (115) should be equal to a multiplicative of the half-wavelength. Similarly, the width, W (116), is also subjected to variations depending on the matching impedance to employ the desired operating frequency. As illustrated in FIG. 3, the side of the folded dipole PCB (101) shown is the ground arm of the folded dipole PCB (101) wherein the excitation arm (not shown) is defined on the other side of the folded dipole PCB (101), but they are symmetrically configured.

Still referring to FIG. 3, the coaxial cable (102) includes an upper terminal (113) at one end and a lower terminal (114) at the other end. The upper terminal (113) is soldered to a proximal end (122) towards an upper edge of the folded dipole PCB (101). The metal shield of the coaxial cable (102) is soldered along the thinner width strip (120) and is extended through the through hole (112). The lower terminal (114) is terminated with a connector, such as a SubMiniature version A (SMA) female connector.

Figure 4:
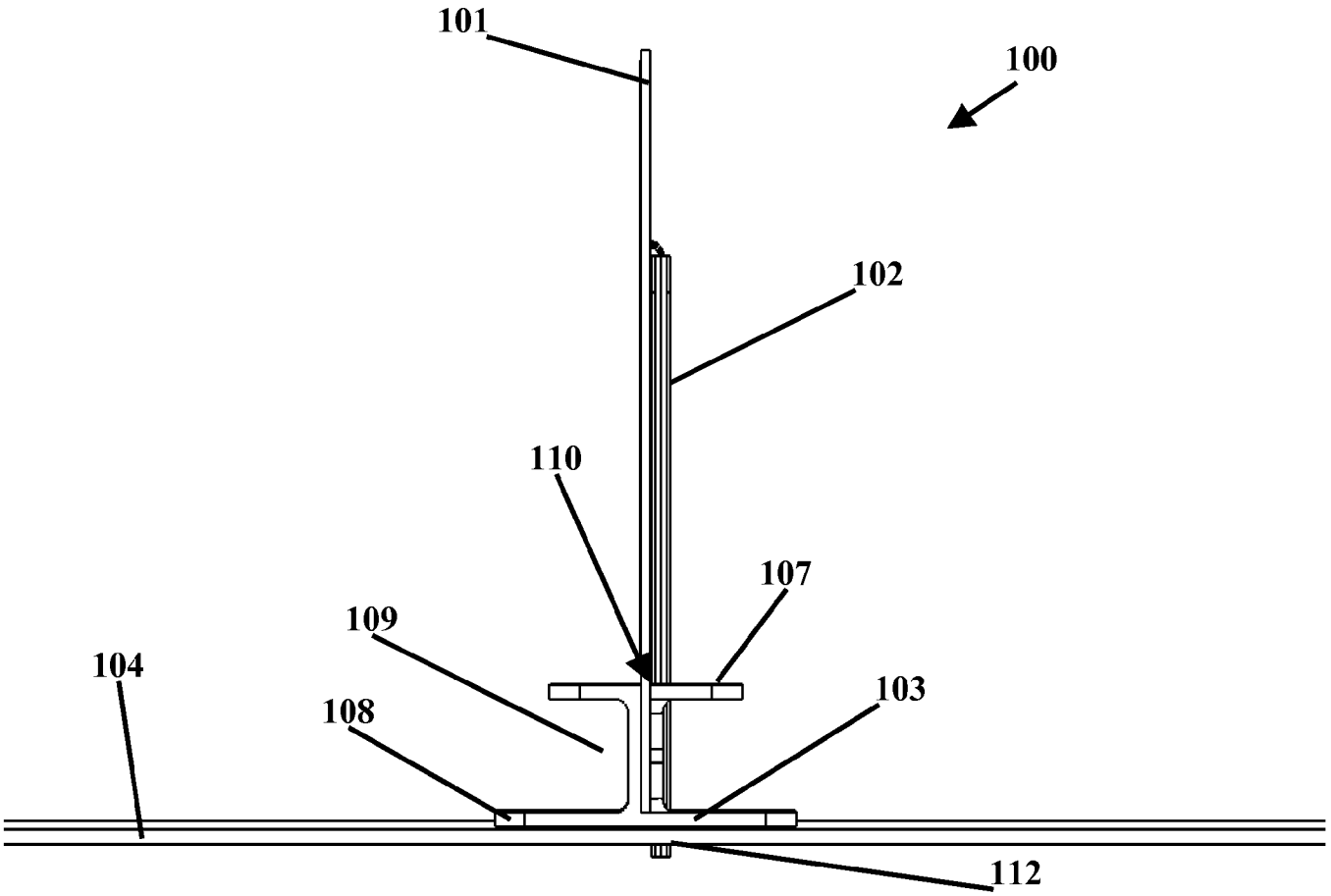
FIG. 4 illustrates a side view of the folded dipole antenna.

FIG. 4 shows a side view of the folded dipole antenna 100, where the inverted-T shaped crossed-section is shown. The coaxial cable (102) is soldered to the folded dipole PCB (101) on the "ground arm" where the first conducting strip (118) and the second conducting strip (119) is defined. The core conductor of the coaxial cable (102) is extended through the folded dipole PCB (101) and in electrical connection with the "excited arm" on the other side of the folded dipole PCB (101), and the metal shield of the coaxial cable (102) is electrically connected to the thinner strip at the "ground arm" side. The coaxial cable (102) runs downwardly along the thinner strip line and terminates with a connector that extends through the through hole (112) of the base plate (104), which ultimately grounds the "ground arm" side of the folded dipole PCB (101).

Figure 5:
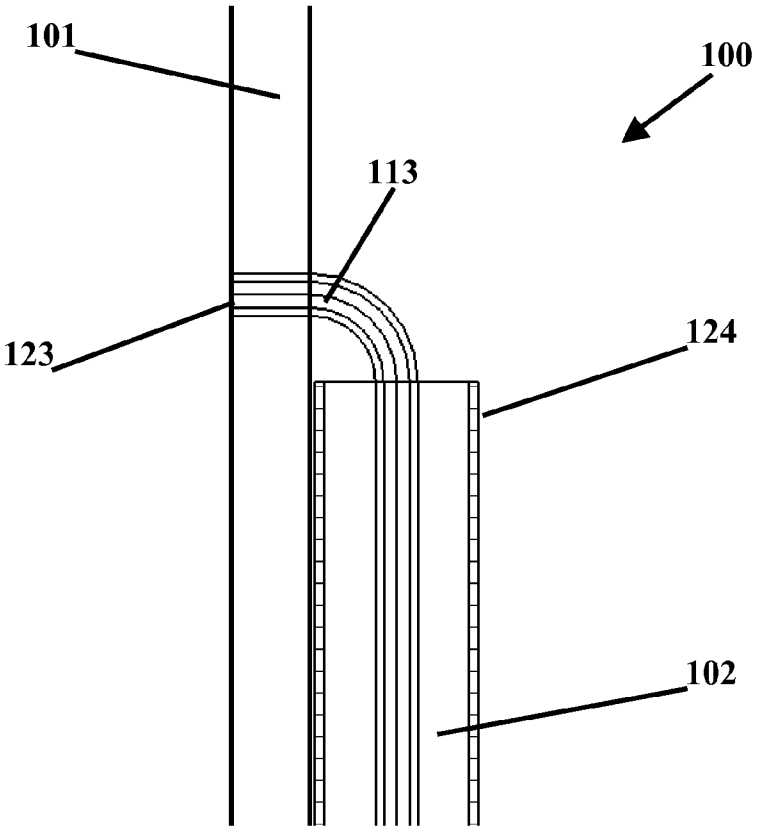
FIG. 5 illustrates a closer view of the cross-sectional view of the folded dipole antenna shown in FIG. 4.

FIG. 5 shows a closer view of the folded dipole antenna (100) shown in FIG. 4. The inner (or core) conductor (123) at the upper terminal (113) of the coaxial cable (102) passes through the substrate of the folded dipole PCB (101) and connects to the first conducting strips on the other side. The outer conductor (124) of the coaxial cable (102) is soldered along the thinner width strip (120) of the second conducting strip (119) on the "ground arm" of the folded dipole PCB (101).

Figure 6:
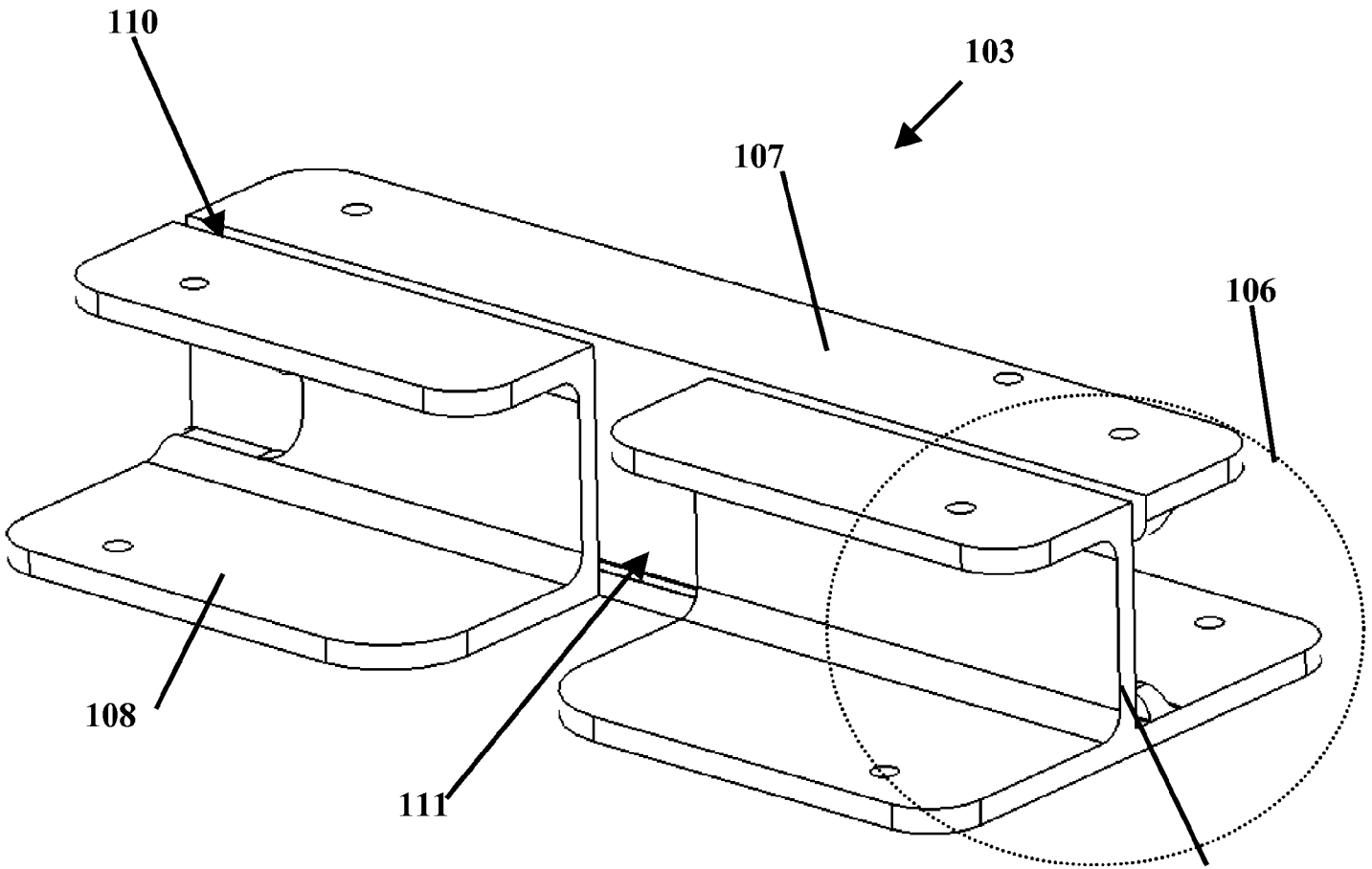
FIG. 6 shows a perspective view of the plastic holder.

FIG. 6 shows a perspective view of the plastic holder (103). The side view of the plastic holder (103) illustrates an I-shaped plastic piece (106). The upper flange (107) of the plastic holder (103) has a shorter length as compared to the lower flange (108). The web (109) connects the upper flange (107) and the lower flange (108) together.

The slot (110) for the folded dipole PCB (101) cuts from the top of the upper flange (107) through the web (109). However, the slot (110) does not cut through the lower flange (108). The cut-off area (111) on the plastic holder (103) allows the coaxial cable (102) to run through faces the "ground arm" side of the folded dipole PCB (101).

In one embodiment of the present invention as shown in FIG. 1, the folded dipole antenna (100) can be adapted to allow a maximum input power of 500 W and has an input impedance of 50Ω. The folded dipole antenna (100) uses DC ground as a lightning protection technique. This technique works by applying a DC ground at a point of minimum radio frequency voltage, conducting static charge to ground without diminishing the radio energy.

The VSWR of the folded dipole antenna (100) is less than 2. The front-to-back ratio, which measures the power gain between the front and the rear of a directional antenna, is greater that 15 dB.

The dimension of the folded dipole antenna (100) in the present embodiment is small in size as compared to other traditional designs of antennas that operates at the same 450-470 MHz range. The total weight of the folded dipole antenna (100) is approximately 1 Kg, and is suitable for applications that require small-size antennas and for commercial purposes. The present invention can be fixed onto walls or ceilings or for indoor reception and small spaces. The folded dipole antenna (100) is of an easy assembly type that can greatly reduce manufacturing time. Traditional designs of the antennas are big in size and bulky in order to receive lower frequencies, and therefore more complicated to manufacture. This makes the present invention more cost-effective as compared to traditional designs.

The above description illustrates various embodiments of the present invention along with examples of how aspects of the present invention may be implemented. While specific embodiments have been described and illustrated it is understood that many charges, modifications, variations and combinations thereof could be made to the present invention without departing from the scope of the present invention. The above examples, embodiments, instructions semantics, and drawings should not be deemed to be the only embodiments, and are presented to illustrate the flexibility and advantages of the present invention as defined by the following claims:

The invention claimed is:

1. A folded dipole antenna capable of transmitting and receiving signals from CDMA 450 system, the folded dipole antenna comprising:

a folded dipole Printed Circuit Board (PCB) having conducting strips defined on each side of the folder dipole PCB forming an excitation arm and a grounding arm of the antenna, both excitation arm and the grounding arm are adapted with symmetric a conducting strip configuration, wherein the conducting strip on each side of the PCB comprising an m-shaped conducting strip having a center conducting leg, and two symmetrically configured folded arms, wherein the center conducting leg is thinner in width than the two folded arms;

a plastic holder whereby the folded dipole PCB is placed through;

a base plate whereby the folded dipole PCB is mounted perpendicularly onto the base plate through the plastic holder; and a coaxial cable having a center core extended through the folded dipole PCB to connect with the excitation arm at one end, and a metal shield soldered along the center conducting leg of the ground arm, wherein the other end of the coaxial cable is extending through the base plate with a connector.

2. The folded dipole antenna of claim 1, wherein the plastic holder made from Polytetrafluoroethylene and is an I-beam shaped plastic piece.

3. The folded dipole antenna of claim 1, wherein the plastic holder comprises an upper flange and a lower flange connected by a web, the plastic holder further define a slot that cuts from the upper flange into the web for receiving the folded dipole PCB there between.

4. The folded dipole antenna of claim 3, wherein one side of the plastic holder has a cut-off area that allows the coaxial cable to run through.

5. The folded dipole antenna of claim 1, wherein the plastic holder supports the folded dipole PCB upright on the base plate.

6. The folded dipole antenna of claim 1, wherein the base plate is provided as a reflector to the folded dipole antenna, to create a directional antenna.

7. The folded dipole antenna of claim 1, wherein two symmetrically configured folded arms have a total average length, L, of approximately 240 mm, a width, W, of approximately 24 mm, and the center conducting strip has a length of approximately 62 mm and a width of 5 mm.

8. The folded dipole antenna of claim 1, wherein the folded dipole PCB has a height of approximately 200 mm.

9. The folded dipole antenna of claim 1, wherein the folded dipole antenna has a front-to-back ratio greater than 15 dB.

10. The folded dipole antenna of claim 1, wherein the folded dipole antenna is capable to have a maximum input power of 500 W.

11. The folded dipole antenna of claim 1 is adapted with a horizontal beam width of 90°±5° and a gain of 6±0.5 dB.

12. The folded dipole antenna of claim 1, wherein the base plate has a length and width of 400 mm.

13. The folded dipole antenna of claim 1, wherein the m-shaped conducting strip defining a gap separating the symmetrically configured folded arms of the m-shaped conducting strip into a first conducting strip and a second conducting strip, the first conducting strip includes one of the symmetrically configured folded arm and the center conducting leg forming an inverted U-shaped conducting strip whilst the second conducting strip includes the other symmetrically configured folded arm forming an inverted L-shaped conducting strip.

14. The folded dipole antenna of claim 1, wherein the folded dipole antenna is operable at 450-470 MHz.

* * * * *